US007546676B2

(12) United States Patent
Austin et al.

(10) Patent No.: US 7,546,676 B2
(45) Date of Patent: Jun. 16, 2009

(54) METHOD FOR MANUFACTURING MICRO-STRIP ANTENNA ELEMENT

(75) Inventors: Timothy B. Austin, Stony Brook, NY (US); Mark W. Duron, East Patchogue, NY (US); Richard Knadle, Dix Hills, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 0 days.

(21) Appl. No.: 11/756,324

(22) Filed: May 31, 2007

(65) Prior Publication Data

US 2008/0295317 A1 Dec. 4, 2008

(51) Int. Cl.
*H01P 11/00* (2006.01)

(52) U.S. Cl. ..... 29/600; 29/601; 29/592.1; 29/832; 156/264; 340/572.1

(58) Field of Classification Search ..... 29/739–740, 29/564.1–564.6; 340/572.4, 572.8, 572.9; 343/787, 895; 156/264, 299, 302
See application file for complete search history.

(56) References Cited

U.S. PATENT DOCUMENTS

| | | | | |
|---|---|---|---|---|
| 4,910,499 | A * | 3/1990 | Benge et al. | 340/572.3 |
| 5,494,550 | A * | 2/1996 | Benge | 156/268 |
| 5,645,932 | A * | 7/1997 | Uchibori | 428/347 |
| 6,951,596 | B2 * | 10/2005 | Green et al. | 29/832 |
| 7,045,186 | B2 * | 5/2006 | Grabau et al. | 428/40.1 |
| 7,107,891 | B2 * | 9/2006 | Kneppe et al. | 83/663 |
| 7,170,415 | B2 * | 1/2007 | Forster | 340/572.4 |
| 7,244,332 | B2 * | 7/2007 | Stromberg et al. | 156/301 |
| 2004/0005754 | A1 * | 1/2004 | Stromberg | 438/222 |
| 2008/0084312 | A1 * | 4/2008 | Daily | 340/572.8 |

* cited by examiner

*Primary Examiner*—Minh Trinh

(57) ABSTRACT

Methods, systems, and apparatuses for automated manufacturing microstrip element antennas is described. The microstrip element antenna comprises a printed circuit layer, a dielectric layer and a ground plane layer. Mass manufacturing process for such microstrip element antennas without any substantial manual assembly process is described. Automation of the manufacturing steps leads to lower production costs, faster production and a higher yield.

9 Claims, 5 Drawing Sheets

METHOD FOR MANUFACTURING MICRO-STRIP ANTENNA ELEMENT

BACKGROUND OF THE INVENTION

1. Field of the Invention

The invention relates to radio frequency identification (RFID) technology, and in particular, to improved manufacturing process for microstrip element antenna used in RFID tags.

2. Background Art

Radio frequency identification (RFID) tags are electronic devices that may be affixed to items whose presence is to be detected and/or monitored. Some RFID tags include microstrip element antennas, also known as patch antennas to transmit and receive information. Microstrip element antennas are mass produced multilayered devices requiring a complicated assembly process. Present assembly techniques for microstrip antennas require a considerable degree of manual assembly thereby increasing the cost of the final product and the production time required for manufacturing an individual microstrip antenna. Because of this complicated assembly process, it is not cost effective to use microstrip antennas for high volume tag applications.

Thus, what is needed are ways to improve and automate manufacturing process for microstrip antenna to reduce the production time and cost.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

Figure 1:
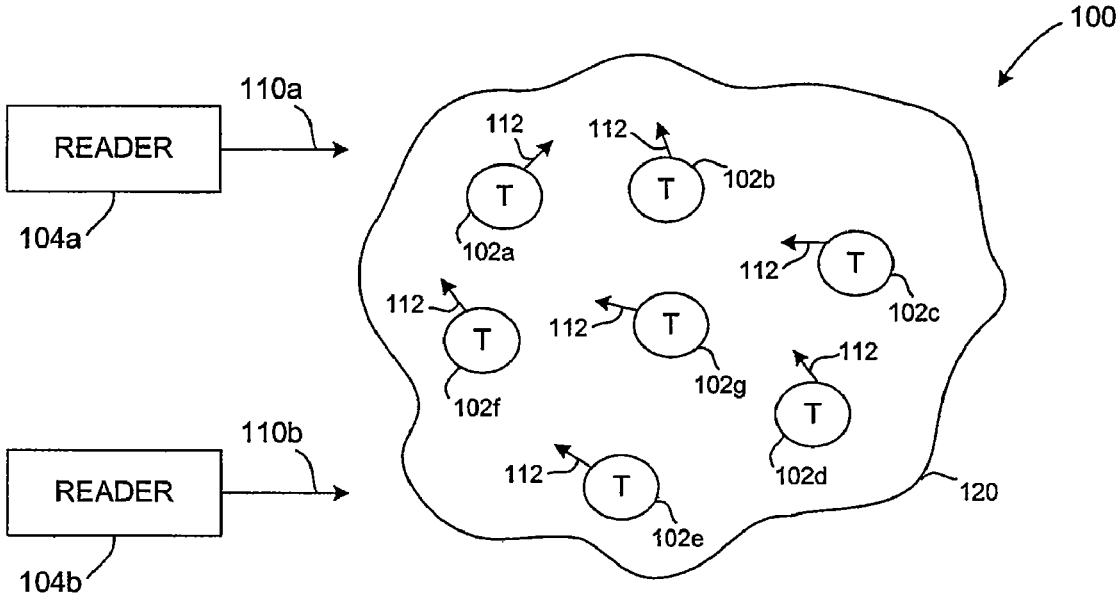
FIG. 1 illustrates an exemplary environment in which RFID readers communicate with an exemplary population of RFID tags.

The present invention will now be described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Introduction

Methods, systems, and apparatuses for RFID devices are described herein. In particular, methods, systems, and apparatuses for improved automated manufacturing of microstrip element antennas are described.

The present specification discloses one or more embodiments that incorporate the features of the invention. The disclosed embodiment(s) merely exemplify the invention. The scope of the invention is not limited to the disclosed embodiment(s). The invention is defined by the claims appended hereto.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Furthermore, it should be understood that spatial descriptions (e.g., "above," "below," "up," "left," "right," "down," "top," "bottom," "vertical," "horizontal," etc.) used herein are for purposes of illustration only, and that practical implementations of the structures described herein can be spatially arranged in any orientation or manner. Likewise, particular bit values of "0" or "1" (and representative voltage values) are used in illustrative examples provided herein to represent data for purposes of illustration only. Data described herein can be represented by either bit value (and by alternative voltage values), and embodiments described herein can be configured to operate on either bit value (and any representative voltage value), as would be understood by persons skilled in the relevant art(s).

Example RFID System

Before describing embodiments of the present invention in detail, it is helpful to describe an example RFID communications environment in which the invention may be implemented. FIG. 1 illustrates an environment 100 where RFID tag readers 104 communicate with an exemplary population 120 of RFID tags 102. As shown in FIG. 1, the population 120 of tags includes seven tags 102*a*-102*g*. A population 120 may include any number of tags 102. One or more tags 102 may include, among other elements, a microstrip element antenna.

Environment 100 includes one or more readers 104. For example, environment 100 includes a first reader 104*a* and a second reader 104*b*. Readers 104*a* and/or 104*b* may be requested by an external application to address the population of tags 120. Alternatively, reader 104*a* and/or reader 104*b* may have internal logic that initiates communication, or may have a trigger mechanism that an operator of a reader 104 uses to initiate communication. Readers 104*a* and 104*b* may also communicate with each other in a reader network.

As shown in FIG. 1, reader 104*a* transmits an interrogation signal 110 having a carrier frequency to the population of tags 120. Reader 104*b* transmits an interrogation signal 110*b* having a carrier frequency to the population of tags 120. Readers 104*a* and 104*b* typically operate in one or more of the frequency bands allotted for this type of RF communication. For example, frequency bands of 902-928 MHz and 2400-2483.5 MHz have been defined for certain RFID applications by the Federal Communication Commission (FCC).

Various types of tags 102 may be present in tag population 120 that transmit one or more response signals 112 to an interrogating reader 104, including by alternatively reflecting and absorbing portions of signal 110 according to a time-based pattern or frequency. This technique for alternatively absorbing and reflecting signal 110 is referred to herein as backscatter modulation. Readers 104*a* and 104*b* receive and obtain data from response signals 112, such as an identification number of the responding tag 102. In the embodiments described herein, a reader may be capable of communicating with tags 102 according to any suitable communication protocol, including but not limited to Class 0, Class 1, EPC Gen 2, other binary traversal protocols, or slotted aloha protocols.

Example Implementation

Figure 2:
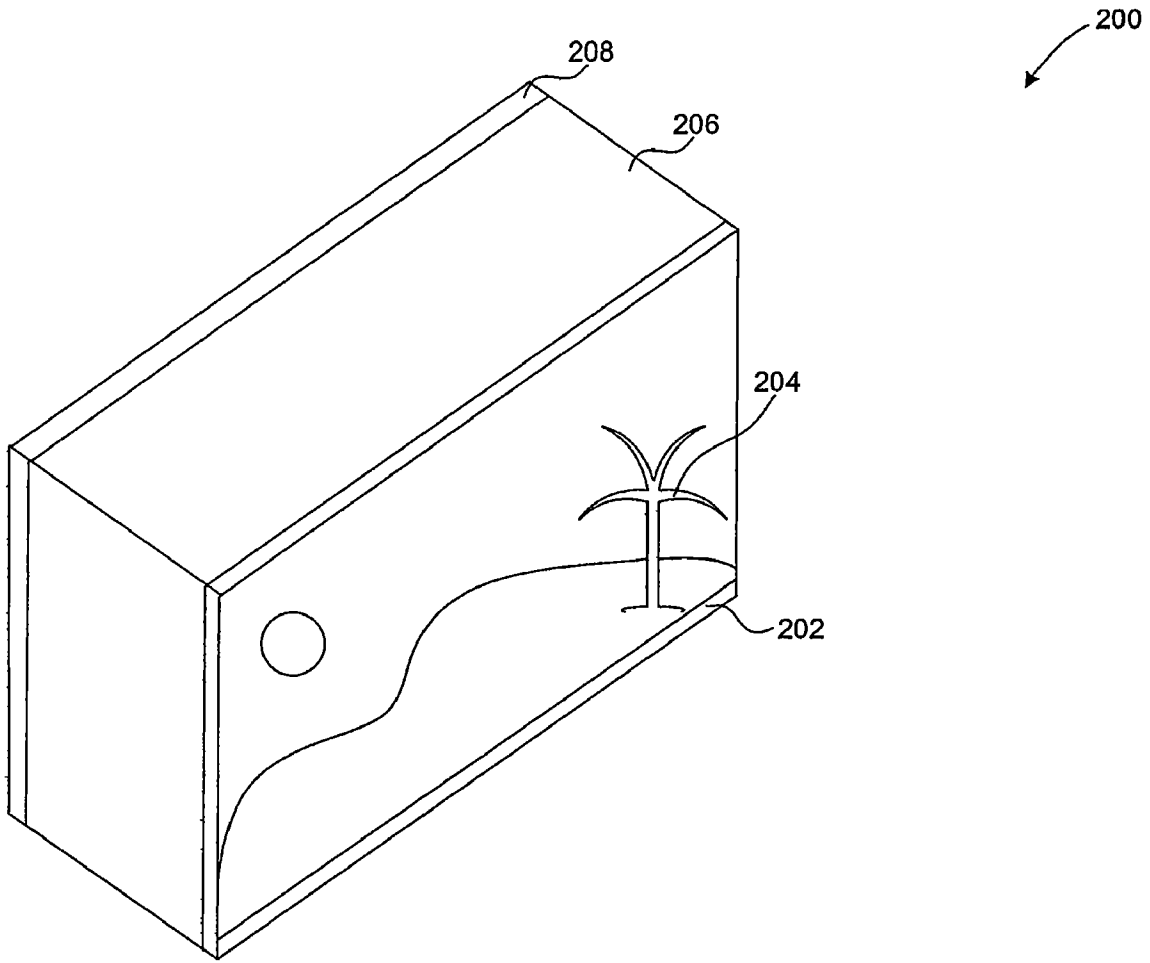
FIG. 2 illustrates a microstrip element antenna, according to an embodiment of the present invention.

FIG. 2 shows an example of a low cost light-weight single microstrip element antenna 200. Such a microstrip element antenna 200 can be used, for example as the antenna for a tag 102 and/or reader 104, in an environment described by FIG. 1, as above. Microstrip element antenna 200 is also known as a patch antenna, as is well known to those skilled in the art. As shown in FIG. 2, microstrip element antenna 200 comprises various layers including a radiator layer 202, a foam core layer 206, and a ground plane layer 208. In an embodiment, radiator layer 202 may have graphics printed thereon. Printed graphics 204 can be a hologram, an identification label or a decorative graphic, depending on specific applications where microstrip element antenna 200 may be used.

Radiator layer 202 can be made of plastic or other flexible materials, well known to those skilled in the art. Radiator layer 202 can further include additional electrical components, resonating elements, circuit traces, and the like. Such electronics components, circuit traces or resonating elements can be placed on the radiator layer 202 by various fabrication techniques, such as thin-film technology.

Foam core 206 can be any dielectric material, for example and not by way of limitation, organic compounds, alloys or plastic. Ground plane layer 208 serves as a ground plane for the components of printed circuit layer 202. Ground plane layer 208 can be made of, for example and not by way of limitation, any standard metal like copper or a suitable alloy.

Figure 3:
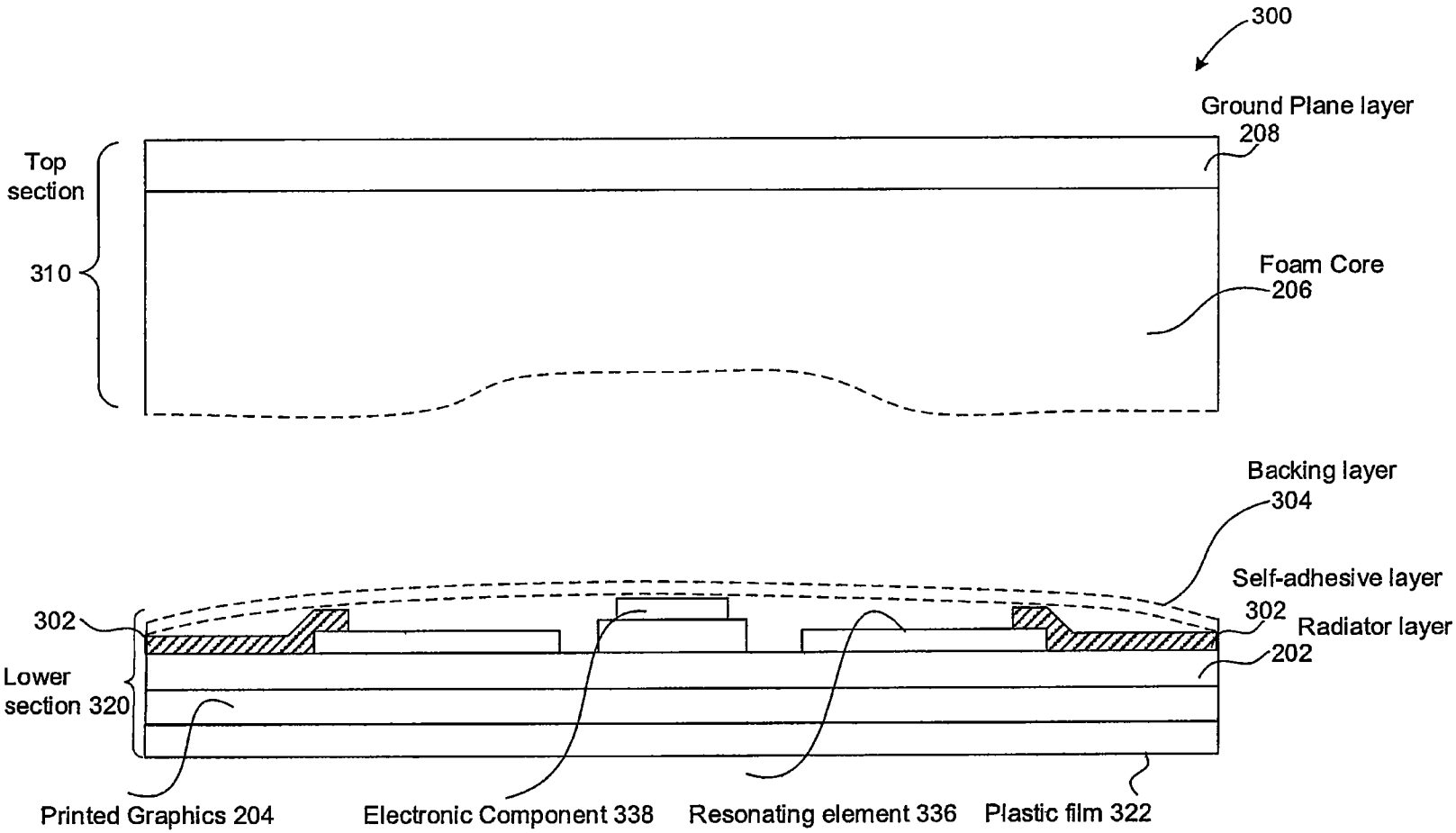
FIG. 3 illustrates a cross-section of a microstrip element antenna showing further details.

Microstrip element antenna 200 is described in further detail in FIG. 3. FIG. 3 shows a cross-section 300 of microstrip element antenna 200, according to embodiments of present invention. FIG. 3 illustrates a microstrip antenna as a top section 310 and a lower section 320 for ease of description. During the manufacturing process, top section 310 is coupled to lower section 320. In addition to the elements mentioned immediately above, cross-section 300 of microstrip element antenna 200 further shows a self-adhesive layer 302 coupled to radiator layer 202. Optionally, radiator layer 202 and/or printed graphics 204 can be covered by a plastic film 322.

In an embodiment, ground plane layer 208 may have self adhesive layer for coupling to foam core layer 206. Foam core layer 206 may have a component recess for electronic component 338, conductive traces and/or resonating element 336 residing on radiator layer 202. The component recess allows for the microstrip antenna to maintain a substantially flat top and bottom surface after assembly. Dimensions of cross-section 300 and therefore, microstrip element antenna 200 can be adjusted and pre-programmed per specific applications.

As illustrated in FIG. 3, a backing layer 304 may be coupled to a top surface of adhesive layer 302. Backing layer 304 is removed from lower section 320 to expose adhesive layer 302. After assembly, foam core layer 206 is coupled to radiator layer 202 via adhesive layer 302.

Figure 4:
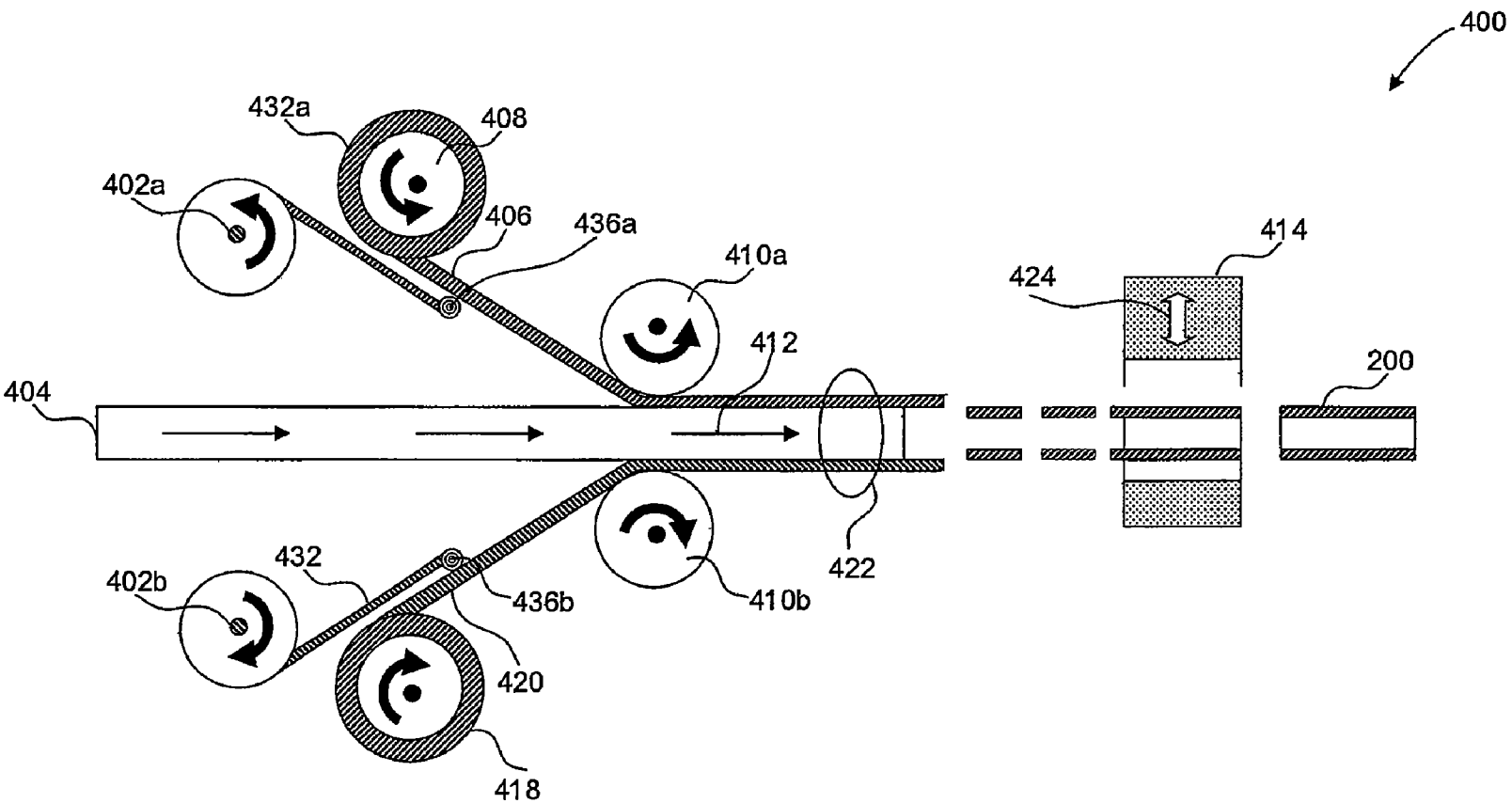
FIG. 4 illustrates an exemplary assembly process for manufacture of a microstrip element antenna, according to another embodiment of the present invention.

FIG. 4 illustrates an exemplary assembly system 400 for manufacture of microstrip element antenna 200, according to one embodiment of the present invention. System 400 receives a roll having a series of lower sections 320 connected in a strip or web (referred to herein as "lower layer strip"). The roll of lower sections 320 is placed on roller 408 such that backing layer 302 is the outermost layer. System 400 also receives a roll having a ground plane strip.

As shown in FIG. 3, ground plane 208 is a self-adhesive ground plane. Accordingly, a backing layer 432 is coupled to the adhesive surface of ground plane 208 to form the ground plane strip. The roll of ground plane strip is placed on roller 418 such that backing layer 432 is the outermost layer.

A foam core strip 404 (also referred to as an extruded foam core strip 404) is moved linearly through system 400 at a pre-determined but adjustable velocity. Foam core strip 404 has a first and a second opposing surface.

The lower layer strip is moved through system 400 by unrolling lower layer strip from roller 408 at a pre-determined velocity. As lower layer strip 406 is unrolled, backing layer 432*a* is removed (or peeled) from the lower layer strip 406 by roller drum 436*a* and roller drum 402*a*. The peeled backing layer 432*a* is deposited on roller drum 402*a*. Roller 408 can be rotated at an adjustable angular velocity. Lower layer strip 406 is rolled out to pinch guide roller 410*a* such that the lower layer strip is drawn between the guide roller 410*a* and the first surface of the foam core strip. Pinch guide roller 410*a* is also rotating at an adjustable angular velocity and acts as a guiding mechanism to attach the lower layer strip 406 to the a first surface of foam core strip 404.

In a similar fashion, the ground plane strip is moved through the system by unrolling the ground plane layer from roller 418. As the ground plane strip is unrolled, backing layer 432*b* is removed (or peeled) from the ground strip by roller drum 436*b* and roller 402*b*. The peeled backing layer 432*a* is deposited on a roller drum 402*b*. Roller 418 can be rotated at an adjustable angular velocity. Ground plane strip 420 is rolled out to pinch guide roller 410*b* such that the ground plane strip is drawn between pinch guide roller 410*b* and the second surface of the foam core strip. Pinch guide roller 410*b* is also rotating at an adjustable angular velocity and acts as a guiding mechanism to attach ground plane strip 420 to the second surface of foam core strip 404.

First roller 410*a* applies a force to lower section strip 406 causing the adhesive layer to couple to the first surface of foam core strip 404. At substantially the same time, roller 410*b* applies a force to ground plane strip 420 causing the adhesive to couple to the second surface of foam core strip 404.

After lower section strip 406 and ground plane strip 420 have been coupled to foam core strip 404, a multi-layered strip 422 is formed on the linearly moving assembly line. Multi-layered strip 422 is then moved to a cutter 414. Cutter 414 can cut multi-layered strip 422 into a plurality of separate microstrip element antennas, similar to microstrip element antenna 200. The size of the resulting microstrip element antennas can be adjusted depending on specific application in which microstrip element antenna is to be used in. Further, cutter 414 can be a mechanical cutting device, a heat cutter, a laser cutting tool, or any other cutting mechanism well known to one skilled in the art. In an embodiment, the motion of cutter 414 as shown by arrow 424, can be adjusted for different speeds of assembly thereby varying the production yield according to a specific need of the application or the environment in which microstrip element antenna 200 is to be used in. In an embodiment, cutter 414 is moving in a direction relatively perpendicular to the linear motion of foam core strip 404, as shown by an arrow 424 on cutter 414.

Figure 5:
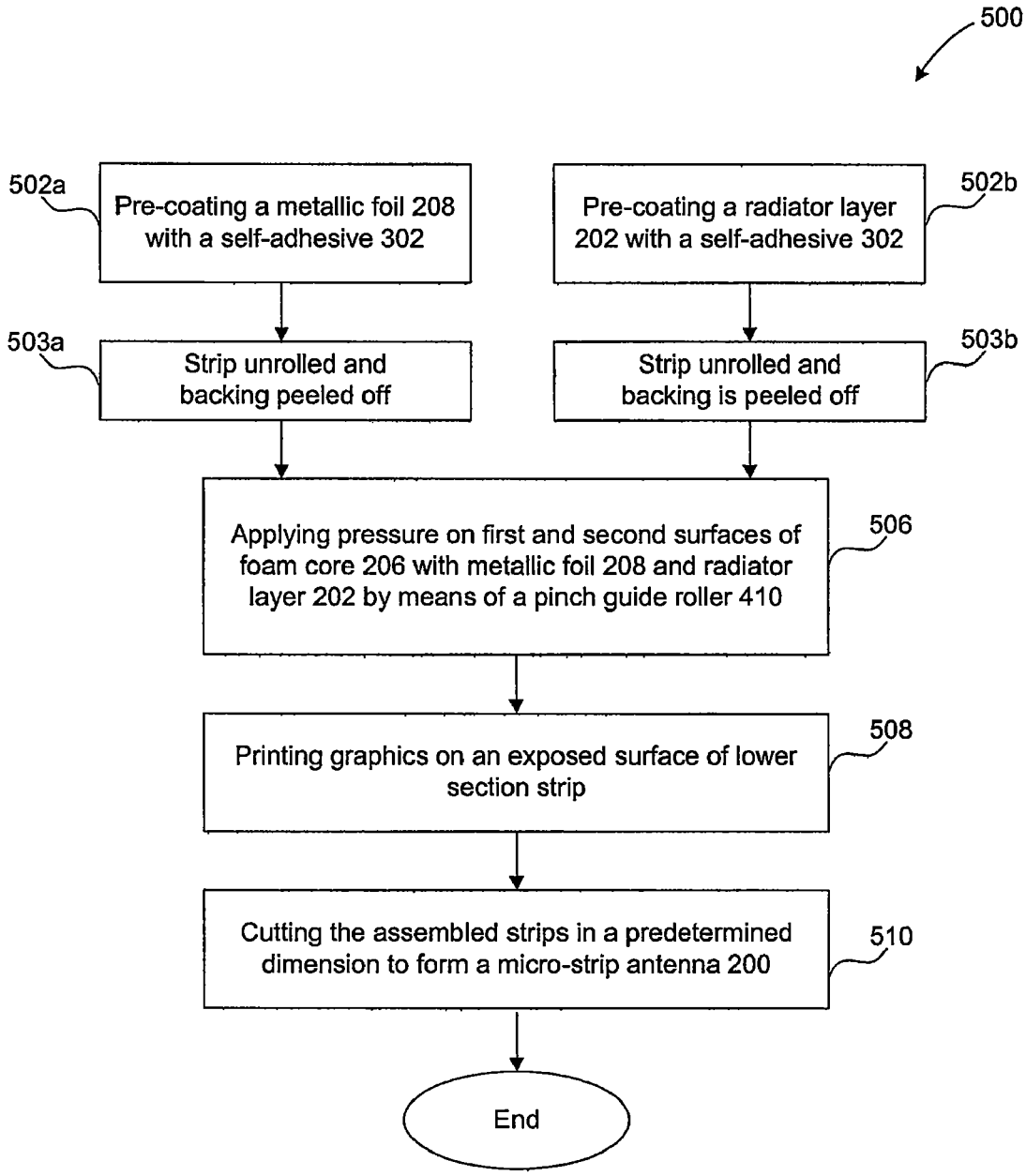
FIG. 5 illustrates a flowchart showing a process for automated mass production of microstrip element antenna.

FIG. 5 illustrates a flowchart 500 of an exemplary assembly process that can be used to manufacture microstrip element antenna 200, according to various embodiments of the present invention. Flowchart 500 is described with continued reference to antenna 200 and system 400. However, flowchart 500 is not limited to those embodiments. Note that the steps in the flowchart 500 do not necessarily have to be in the order shown.

In step 502*a*, a roll having a self-adhesive ground plane strip is placed on feed roller 418. Similarly, in step 502*b*, a roll having a strip of lower sections is placed on a feed roll 408.

In step 503*a*, ground plane strip is unrolled and backing 432 is peeled off. Ground plane roll is also drawn between pinch guide roller 410*b* and the second surface of the foam core strip.

Similarly, in step 503*b*, the lower section strip is unrolled and backing 432 is peeled off (or removed). Lower section strip is also drawn between pinch guide roller 410*a* and the first surface of foam core strip 404.

In step 506, ground plane strip 420 is attached to a first surface of foam core strip 404. Roller 410*b* applies a force to cause a surface of foam core strip 404 and ground plane strip 420 to adhere. At the same time, lower section strip is attached to the opposing surface of foam core strip 404 using roller 410*a*. As lower section moves under roller 410*a*, roller 410*a* asserts a force on lower section strip causing the strip to adhere to the first surface of foam core strip 404.

The angular velocity of rollers is adjustable such that it substantially matches with the linear velocity of foam core strip 404, Throughout the steps 502-506, foam core strip 404 is moving linearly in a fixed direction at a fixed velocity. However, as can be easily contemplated by those skilled in the art, the direction and velocity of motion of various elements of the present invention can be adjusted by programming, or other techniques.

Step 508 is optional. In step 508, graphics may be printed on an exposed surface of lower section strip 406. Alternatively, graphics may be printed on lower section strip prior to the assembly process 500.

In step 510, individual multi-layered microstrip antenna element 200 are formed by cutting through the assembled strip. The cutting techniques and cutting dimensions may vary as per the need of the application in which microstrip element antenna 200 may be used, as is well known to those skilled in the art.

Alternative embodiments of the microstrip element antenna 200 can be contemplated by those skilled in the art after reading this disclosure. Further, microstrip element antenna 200 may be used in conjunction with any type of reader antenna known to persons skilled in the relevant art(s), including a vertical, dipole, loop, Yagi-Uda, or slot antenna type. For description of an example antenna suitable for reader 104, refer to U.S. Ser. No. 11/265,143, filed Nov. 3, 2005, titled "Low Return Loss Rugged RFID Antenna," now pending, which is incorporated by reference herein in its entirety.

The methods and systems described herein maybe applicable to a manufacturing process of any type of microstrip element antenna 200, for example a patch antenna. Microstrip element antenna 200 can further include a substrate and an integrated circuit (IC). Further, microstrip element antenna 200 may include any number of one, two, or more separate antennas and thus, can be a part of an antenna array. Further still, in an array configuration, microstrip element antenna 200 can be implemented as any suitable antenna type, including dipole, loop, slot, or patch antenna type.

Conclusion

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A method for automatic assembly of a microstrip element antenna, comprising:

moving a foam core strip, having opposing first and second surfaces at a fixed velocity in a first direction;

unrolling a ground plane strip from a first roller at a first rate consistent with the fixed velocity of the foam core strip;

unrolling a lower section strip from a second roller at a second rate consistent with the fixed velocity of the foam core strip;

simultaneously attaching a portion of the ground plane strip to the first surface of the foam core strip and a portion of the lower section strip to the second surface of the foam core strip to generate an assembled microstrip antenna strip; and cutting the assembled microstrip antenna strip to create individual microstrip antennas.

2. The method of claim 1, further comprising:

removing the backing layer from the ground plane strip prior to the attachng step to expose as adhesive surface of the ground plane strip.

3. The method of claim 2, further comprising:

removing a backing layer from the lower section strip prior to the attaching step to expose an adhesive surface of the lower section strip.

4. The method of claim 3, wherein the attaching step comprises:

drawing the ground plane strip between the first surface of the foam core strip and a third roller such that the adhesive surface of the ground plane strip contacts the first surface of the foam core strip; and applying a pressure to the ground plane strip to cause the ground plane strip to adhere to the first surface of the foam core strip.

5. The method of claim 4, wherein the attaching step comprises:

drawing the lower section strip between the second surface of the foam core strip and a fourth roller such that the adhesive surface of the lower section strip contacts the second surface of the foam core strip; and applying a pressure to the lower section strip to cause the lower section strip to adhere to the second surface of the foam core strip.

6. The method of claim 1, wherein the step of cutting comprises:

cutting the assembled micro strip antenna using a set of user-adjustable dimensions to create the individual microstrip antennas.

7. The method of claim 1, further comprising:

incorporating an image into the lower section strip of the assembled microstrip antenna prior to cutting the assembled microstrip antenna.

8. The method of claim 1, further comprising:

prior to moving the foam core strip, receiving a lower section strip having a series of images incorporated thereon.

9. The method of claim 1, wherein the first rate and the second rate are user-adjustable.

* * * * *

UNITED STATES PATENT AND TRADEMARK OFFICE

CERTIFICATE OF CORRECTION

PATENT NO. : 7,546,676 B2
APPLICATION NO. : 11/756324
DATED : June 16, 2009
INVENTOR(S) : Austin et al.

It is certified that error appears in the above-identified patent and that said Letters Patent is hereby corrected as shown below:

IN THE SPECIFICATION

In Column 4, Line 22, delete "the a" and insert -- the --, therefor.

IN THE CLAIMS

In Column 6, Line 27, in Claim 2, delete "attachng" and insert -- attaching --, therefor.

In Column 6, Line 53, in Claim 6, delete "micro strip" and insert -- microstrip --, therefor.

Signed and Sealed this

Sixteenth Day of February, 2010

David J. Kappos

David J. Kappos
*Director of the United States Patent and Trademark Office*